United States Patent [19]

Mildern

[11] 4,211,347

[45] Jul. 8, 1980

[54] VALVE

[76] Inventor: William D. Mildern, 1121 W. McNab Rd., Pompano Beach, Fla. 33060

[21] Appl. No.: 972,260

[22] Filed: Dec. 22, 1978

[51] Int. Cl.[3] ..... B65D 83/14

[52] U.S. Cl. ..... 222/402.18; 137/595; 222/402.24

[58] Field of Search ..... 137/595; 222/402.1, 222/402.18, 402.24; 251/353

[56] References Cited

U.S. PATENT DOCUMENTS

| | | | |
|---|---|---|---|
| 3,061,203 | 10/1962 | Kitabayashi | 222/402.18 X |
| 3,606,963 | 9/1971 | Marand | 222/402.18 X |
| 3,612,362 | 10/1971 | Champagne | 222/402.24 |
| 3,615,042 | 10/1971 | Marand | 222/402.24 X |
| 3,669,316 | 6/1972 | Corsette | 222/402.24 X |
| 3,841,602 | 10/1974 | Mildern | 251/353 |
| 3,982,674 | 9/1976 | Mildern | 222/402.24 X |

*Primary Examiner*—Robert G. Nilson
*Attorney, Agent, or Firm*—Oltman and Flynn

[57] ABSTRACT

The present valve is for use on an aerosol container having a propellant. It has an axially displaceable, tubular valve body with an eduction passageway leading up to an orifice located below an internal dividing wall, and a product discharge passageway leading up from another orifice located above this wall. An upper, annular, elastomeric gasket closes these orifices in the normal position of the valve body. A lower, annular, elastomeric gasket directly below the upper gasket normally closes a separate propellant discharge passageway in the valve in the normal position of the tubular valve body. When the valve body is displaced downward from its normal position, a first annular passageway is formed between the two gaskets to connect the eduction passageway to the product discharge passageway, and a second annular passageway is formed below the lower gasket to open the propellant discharge passageway to pass gaseous propellant from inside the container. The flow of the gaseous propellant from inside the container is restricted before reaching the lower gasket and the propellant discharge passageway.

22 Claims, 17 Drawing Figures

FIG. 1
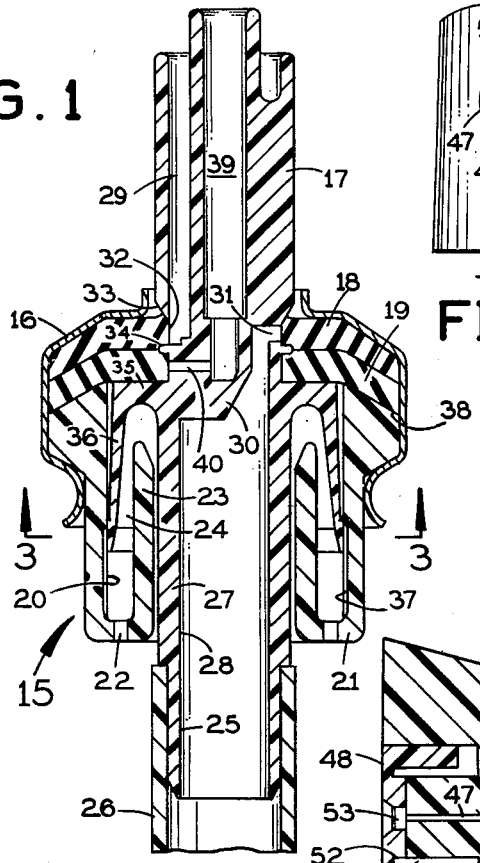
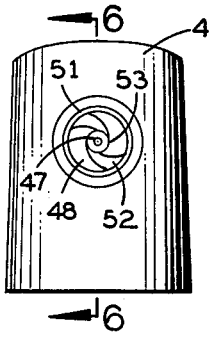
FIG. 5
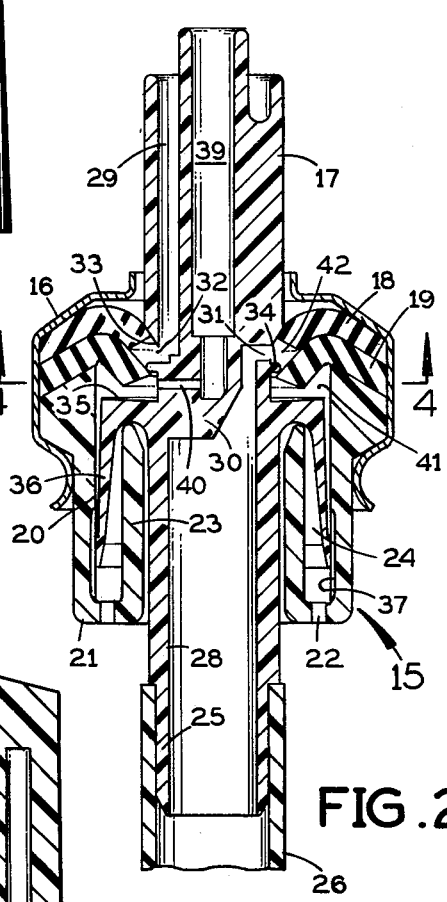
FIG. 2
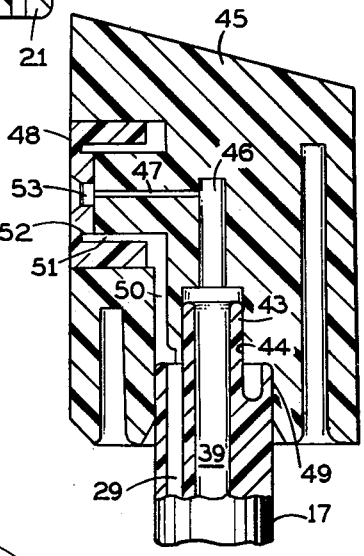
FIG. 6
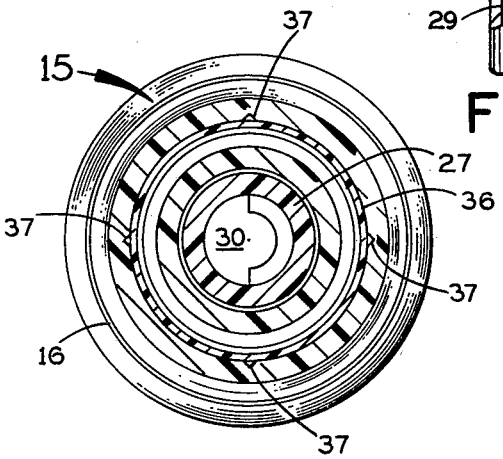
FIG. 3
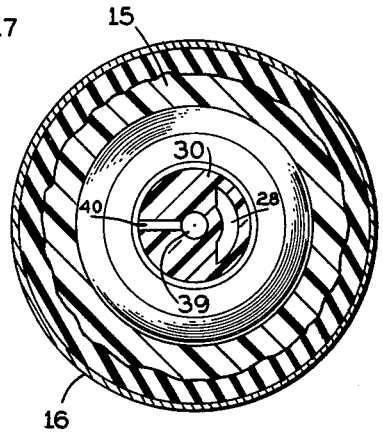
FIG. 4

VALVE

BACKGROUND OF THE INVENTION

The adverse environmental effects of chlorofluorocarbons as propellants, which have been in widespread use in pressurized aerosol dispensers, have led to their replacement by hydrocarbons, carbon dioxide and other non-miscible or not readily miscible propellants. The hydrocarbons, which are most commonly used, are highly flammable and would be dangerously volatile if combined with the solvents formerly used in aerosol mixtures intended for use with fluorocarbon propellants.

To avoid dangerous volatility the aerosol product solutions have been changed to water soluble formulations. The aerosols have a three layered formation in the container because the hydrocarbon propellant, a paraffin derivative, is not miscible with the water based solution. In the container the water based product solution is at the bottom. Floating on top of the product solution is a non-miscible hydrocarbon layer in a liquid state. Above this liquid hydrocarbon layer the remainder of the container is occupied by the hydrocarbon propellant in its gaseous state.

The product is dispensed from the container by opening a dispensing valve in the usual manner, with the gaseous pressure of the hydrocarbon propellant forcing the product up through the usual eduction tube and through the dispensing valve to the spray nozzle. As the product is dispensed from the container, the liquid hydrocarbon layer on top vaporizes thereby maintaining an adequate propellant gas pressure inside the container.

With non-miscible or partially miscible propellants, such as the hydrocarbons substituted for the previous propellants, the aerosol dispensers of the type formerly in widespread use tended to produce a product spray which was too coarse and contained irregular sized droplets. Some improvement is achieved by providing a vapor tap in the valve housing to permit some of the gaseous propellant to enter the stream of water-based product for breaking up the product droplets as they are sprayed. However, this expediant has not been entirely effective in that the product spray still is coarse compared to the spray achieved with the fluorocarbon propellants. Also, if the user shakes the container before or during use, some liquid hydrocarbons may enter the vapor tap and be spit out of the discharge nozzle, presenting a serious safety hazard because of flammability. Also, shaking may cause small particles of foreign matter to enter and clog the vapor tap or orifices thus interfering with its effectiveness. A proposal to alleviate these problems is described in "Aerosol Age," July, 1977 pages 18–21, the article entitled "Precision unveils hydrocarbon water-based Aquasol system."

SUMMARY OF THE INVENTION

The present invention is directed to a novel dispensing valve for aerosol containers which overcomes problems with hydrocarbons and other non-miscible or flammable propellants.

The present invention also incorporates the advantages of the valve disclosed in FIGS. 5–10 of my U.S. Pat. No. 3,982,674.

A principle object of the present invention is to provide a novel and improved dispensing valve for aerosol containers wherein the product and propellant are maintained in separate discharge streams until they reach the nozzle.

Another object of the invention is to have a nozzle designed as a swirl chamber wherein the product enters tangentially at a high velocity and pressure. This violent high speed swirling causes the product to break up into a fine mist. Simultaneously the gaseous propellant violently impacts the vortex of the swirling product mist at high velocity and pressure which further breaks up the product mist and forms a homogeneous vapor.

Another object of the invention is to seal a piston in the valve effectively and economically.

Another object of this invention is to provide such a dispensing valve which prevents liquid propellant from reaching the spray nozzle as a result of shaking the container.

Another object of this invention is to provide dual shut-off on both the propellant orifices and passageways as well as the dual shut-off of the products orifices and passageways.

Also, an object of this invention is to provide such a dispensing valve which filters out any foreign particles before they can reach the discharge passageway or orifices in the valve.

Further objects and advantages of this invention will become apparent from the following detailed description of several presently preferred embodiments thereof, which are shown in the accompanying drawings in which:

FIG. 1 is a vertical longitudinal sectional view of a first embodiment of the present valve in its closed position on the upper end of an eduction tube in an aerosol container;

FIG. 2 is a similar view showing the valve opened;

FIG. 3 is a horizontal cross-section taken along the line 3—3 in FIG. 1;

FIG. 4 is a horizontal cross-section taken along the line 4—4 in FIG. 2;

FIG. 5 is a side elevational view of the spray cap for attachment to the upper end of this valve;

FIG. 6 is a vertical section taken along the line 6—6 in FIG. 5, showing the spray cap attached to the valve;

Figure 7:
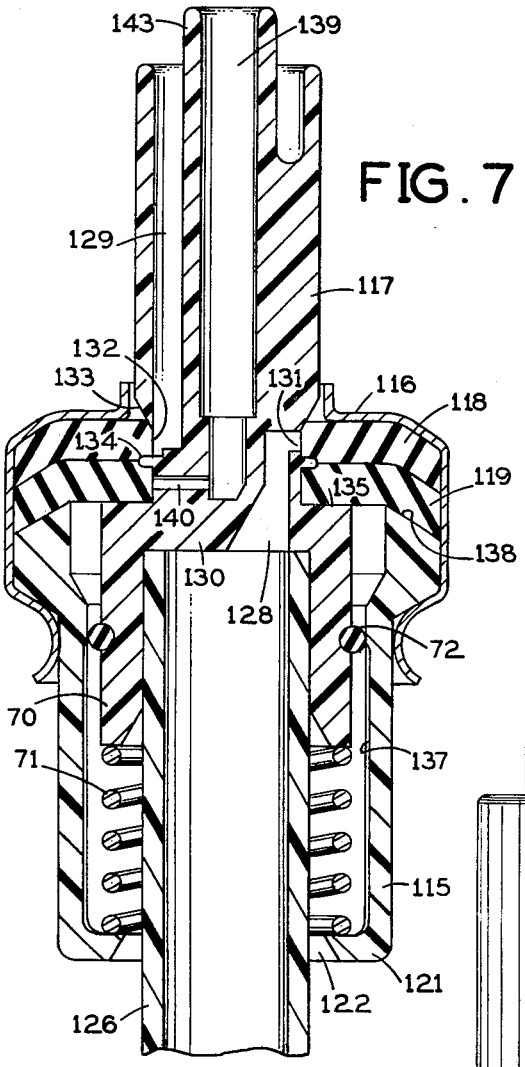
FIG. 7 is a vertical longitudinal section through a second embodiment of the present valve in its closed position.

Before explaning the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Referring first to FIG. 1, the valve shown there is similar in many respects to the valve disclosed in FIG. 5 of my U.S. Pat. No. 3,982,674. It comprises an annular mounting means in the form of a plastic mounting ring 15 for attachment to the mouth of the aerosol container by means of a conventional metal mounting cup 16. A plastic valve body 17 is slidably mounted in the mounting ring 15 for up and down movement. A pair of annular elastomeric gaskets 18 and 19 are clamped between the top of the mounting ring 15 and the inside of the mounting cup 16 for coaction with the valve body 17, as explained in detail hereinafter.

The mounting ring 15 presents an annular outer wall with a generally cylindrical inside surface 20, a transverse, horizontal bottom wall 21 extending radially inward from the lower end of the outer wall and formed with several openings 22, and an annular inner wall 23 extending up from the bottom wall 21 and spaced radially inward from the outer wall to define therewith an annular recess 24 which is open at the top.

The valve body 17 has a reduced lower end segment 25 which is snugly received inside the upper end of an eduction tube 26 extending down into the aerosol container to withdraw product therefrom. Above its reduced lower end segment 25 the valve body presents a tubular vertical segment 27 which extends loosely down through the annular inner wall 23 of the mounting ring 15. The valve body segments 25 and 27 define a vertical eduction passageway 28 for receiving product from the eduction tube 26.

The upper end of the valve body 17 defines a laterally offset, vertically extending, product discharge passageway 29 which is open at the top. The lower end of this product discharge passageway 29 is blocked from the upper end of the eduction passageway 28 by an internal wall 30 of the valve body. This internal wall has vertically offset, transversely extending protions at the upper end of the eduction passageway 28 and the lower end of the product discharge passageway 29, respectively, so that the upper end of passageway 28 extends slightly above the lower end of passageway 29.

The eduction passageway 28 extends up on one side of the dividing wall 30 to an orifice 31, which is open at the right side of the valve body in FIG. 1. On the opposite sides of the dividing wall 30 the lower end of the product discharge passageway 29 is connected to an orifice 32, which is open at the left side of the valve body 17 in FIG. 1. The bottom edge of the product discharge passageway orifice 32 is slightly below the bottom edge of the eduction passageway orifice 31, for the purpose explained in detail in my aforementioned U.S. Pat. Nos. 3,841,602 and 3,982,674.

Just above the orifices 31 and 32 the valve body presents an inwardly and downwardly tapered peripheral surface 33 which normally sealingly engages and slightly deforms the inside top edge of the upper gasket 18 around its central opening, as shown in FIG. 1.

Just below the orifices 31 and 32 the valve body presents a transverse, outwardly projecting, annular circumferential lip 34 which normally is sandwiched between the bottom of the upper gasket 18 and the top of the lower gasket 19 at the aligned central openings in these gaskets.

At a location spaced below this lip 34 not less than the thickness of the lower gasket 19, the valve body presents a horizontal, flat, annular, upwardly-facing, outwardly extending shoulder 35 which normally sealingly engages the lower gasket 19 from below for about half the latter's radial extent outward from its central opening. The central opening in the lower gasket 19 snugly receives the valve body between the annular lip 34 and the upwardly-facing shoulder 35 in the normal position of the valve body (FIG. 1).

The remaining outer half of the lower gasket 19 is engaged by the conical top face 38 of the mounting ring. The upper gasket 18 is snugly engaged from above by the metal mounting cup 16 so that it snugly overlies the lower gasket 19 throughout the latter's radial extent, except at the lip 34 sandwiched between them at the inside. Note that the gaskets are isolated from damaging attacks by the container's contents.

Below the shoulder 35, the valve body presents a depending annular skirt 36 which slidably sealingly engages the inside face 20 of the mounting ring. The outside of this skirt is slightly tapered outwardly and downwardly, as shown in FIG. 1, in the normal position of the parts.

In accordance with the present invention, the inner wall of the mounting ring 15 is formed with a plurality of longitudinal grooves 37 at circumferentially spaced locations on its inside face 20. At their lower ends these grooves communicate with the bottom openings 22 in the mounting ring. The upper ends of the grooves are a short distance below the conical top face 38 of the mounting ring starting just below the sealing point of the skirt 36. They are about midway between the face 38 and opening 22. Thus there is a double shut off for both product and propellant gases. In the lowered position of the valve (FIG. 2), the upper ends of these grooves communicate with the bottom face of the lower gasket 19 through the tapered space between the periphery of the depending skirt 36 on the valve body 17 and the inside of the mounting ring 15.

The upper half of the valve body is formed with a central, vertical propellant discharge passageway 39 with a reduced lower end which extends down into the dividing wall 30 below the annular lip 34 on the outside of the valve body. A lateral passage 40 (FIG. 4) extends horizontally through this dividing wall into the lower end of the propellant discharge passageway 39. As shown in FIG. 1, the vertical position of the lateral passage 40 is about midway between the annular lip 34 and the upwardly facing shoulder 35 on the valve body. Consequently, in the normal position of the valve body (FIG. 1) the outer end of the lateral passage 40 is sealed by the annular inside surface of the lower gasket 19 at its central opening.

When the valve body 17 is pushed down from the FIG. 1 position to the FIG. 2 position, its annular lip 34 will flex the lower gasket 19 downward in an annular region of the gasket from its central opening outward to where it engages the top face 38 of the mounting ring 15. While this is happening, the upwardly-facing shoulder 35 on the valve body will move down away from the lower gasket 19 as shown in FIG. 2, to provide an annular passageway 41 between them at the outside of the valve body 17 and at the inside of the mounting ring 15 at the latter's upper end. This passageway 41 connects the upper ends of the grooves 37 on the inside of the mounting ring to the outer ends of the lateral passage 40 leading into the lower end of the propellant discharge passageway 39, as shown in FIG. 4. Consequently, the gaseous propellant inside the top of the container is supplied to the propellant discharge passageway 39 through the restricted flow passages provided by the grooves 37.

Also, when the valve body 17 is pushed down, its tapered edge 33 flexes the upper gasket 18 down at the inside to provide an annular connecting passageway 42 which, as shown in FIG. 2, registers with the orifice 31 at the upper end of the eduction passage 28 and with the orifice 32 at the lower end of the product discharge passage 29 in the valve body. This connecting passageway 42 is formed between the inside edge of the upper gasket 18 and the tapered edge 33 of the valve body, at the top, and the transverse lip 34 on the valve body and the top of the downwardly-flexed inner segment of the lower gasket 19, at the bottom. This connecting passageway enables product to flow up into the discharge passage 29 in the valve body from the inside of the container via the eduction tube 26, the eduction passageway 28 in the lower half of the valve body, and the valve body orifices 31 and 32, both of which register with the connecting passageway 42 at this time.

Referring to FIG. 6, the valve body 17 presents an upwardly projecting, hollow, central stem 43 at the upper end of its propellant passageway 39 which fits snugly into a complementary downwardly-facing bore 44 formed in the bottom of the spray cap 45. Above this recess the spray cap has a central, upwardly extending propellant passage 46 leading to a constricted horizontal passage 47 extending longitudinally through a spray nozzle 48 in the spray cap.

Below the stem 43 the upper end of the valve body 17 fits snugly into a counterbore 49 formed in the bottom of the spray cap concentric with the bore 44. At the upper end of this counterbore, at the left side in FIG. 6, the spray cap has an upwardly extending passage 50 for passing product up from the product discharge passageway 29 in the valve body 17. The upper end of this passage 50 is connected to an annular chamber 51 formed between the spray nozzle 48 and the spray cap 45 and extending circumferentially around the propellant passage 47 through the spray nozzle. Transverse passages 52 in the spray nozzle extend inward from opposite sides of this recess 51 into the propellant passage 47 tangent to its periphery, as shown in FIG. 5, at a location just downstream past the smallest diameter portion of passage 47 as shown in FIG. 6. Consequently, product is swirled which breaks it up considerably. The gas discharges into the vortex of the product. The impact of the gaseous stream on the product promotes a mixing action in which the product is broken up into tiny droplets of reasonably uniform size. The result is a fine mist and homogenization.

The size of the passageways provided by the grooves 37 in the mounting ring is small enough to prevent any liquid hydrocarbon from getting into the propellant discharge passageway 39 if the container is shaken. Also, these groove passageways are small enough to catch and trap any particles of foreign matter and prevent such particles from getting into the lateral passage 40 or the propellant discharge passageway 39.

Figure 8:
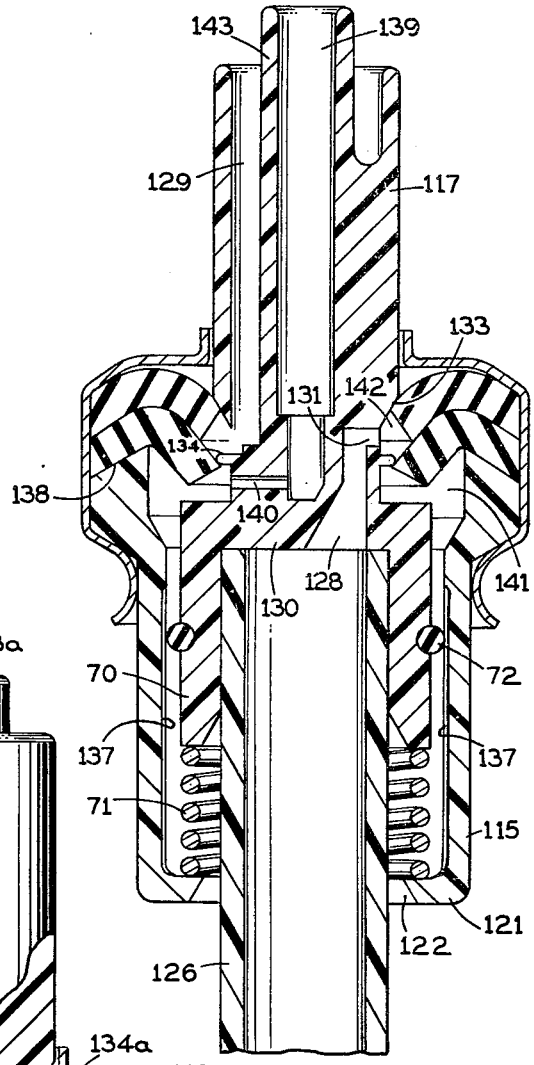
FIG. 8 is a similar view showing the FIG. 7 valve opened.

FIGS. 7 and 8 show a second embodiment of the present valve. In these Figures, elements of the valve which correspond to those in FIGS. 1–4 are given the same reference numerals plus 100. The detailed description of these corresponding elements is unnecessary to repeat.

Referring to FIG. 7, the eduction tube 126 has its upper end snugly received in a transversely enlarged cylindrical lower end 70 on the valve body 117. A coil spring 71 is engaged between the bottom edge of the valve body and the bottom wall 121 of the mounting ring to bias the valve body to the position shown in FIG. 7. The enlarged lower end 70 of the valve body carries an O-ring 72 of tubber or rubber-like material which sealingly engages the inside of the mounting ring 115 immediately above the upper ends of the latter's internal grooves 137 in the normal position of the parts, as shown in FIG. 7.

When the valve body is pushed down (FIG. 8) the O-ring 72 moves down out of sealing engagement with the inside of the mounting ring 115, and the internal grooves 137 in the mounting ring pass the gaseous propellant from the inside of the aerosol container up into the lower connecting passageway 141 leading to the lateral passage 140 at the lower end of the propellant passageway 139.

The upper and lower flanges 118 and 119 are flexed downward at the inside essentially as described with reference to FIGS. 1–4 to provide the upper and lower connecting passageways 142 and 141 for respectively passing product and propellant up into the passageways 129 and 130.

Figure 9:
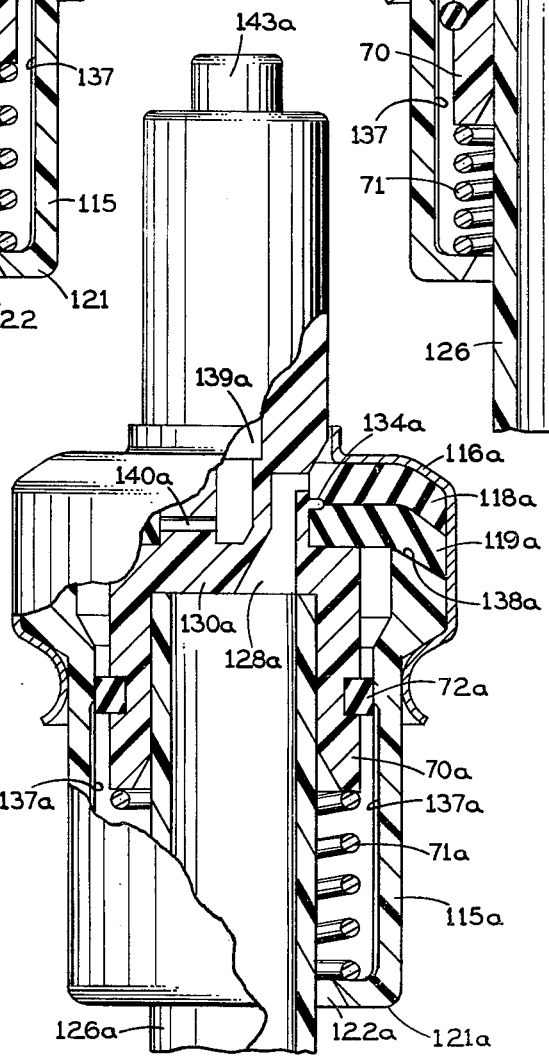
FIG. 9 is a view similar to FIG. 1 of a third embodiment of the present valve.

FIG. 9 shows a third embodiment of the present valve which is essentially the same as the one shown in FIGS. 7 and 8, except that in FIG. 9 the O-ring is of rectangular cross-section instead of circular cross-section, as in FIGS. 7 and 8. Elements of the FIG. 9 valve which correspond to the elements of the FIG. 7 valve have the same reference numerals, with an "a" suffix added.

Figures 10, 11, 12, 13:
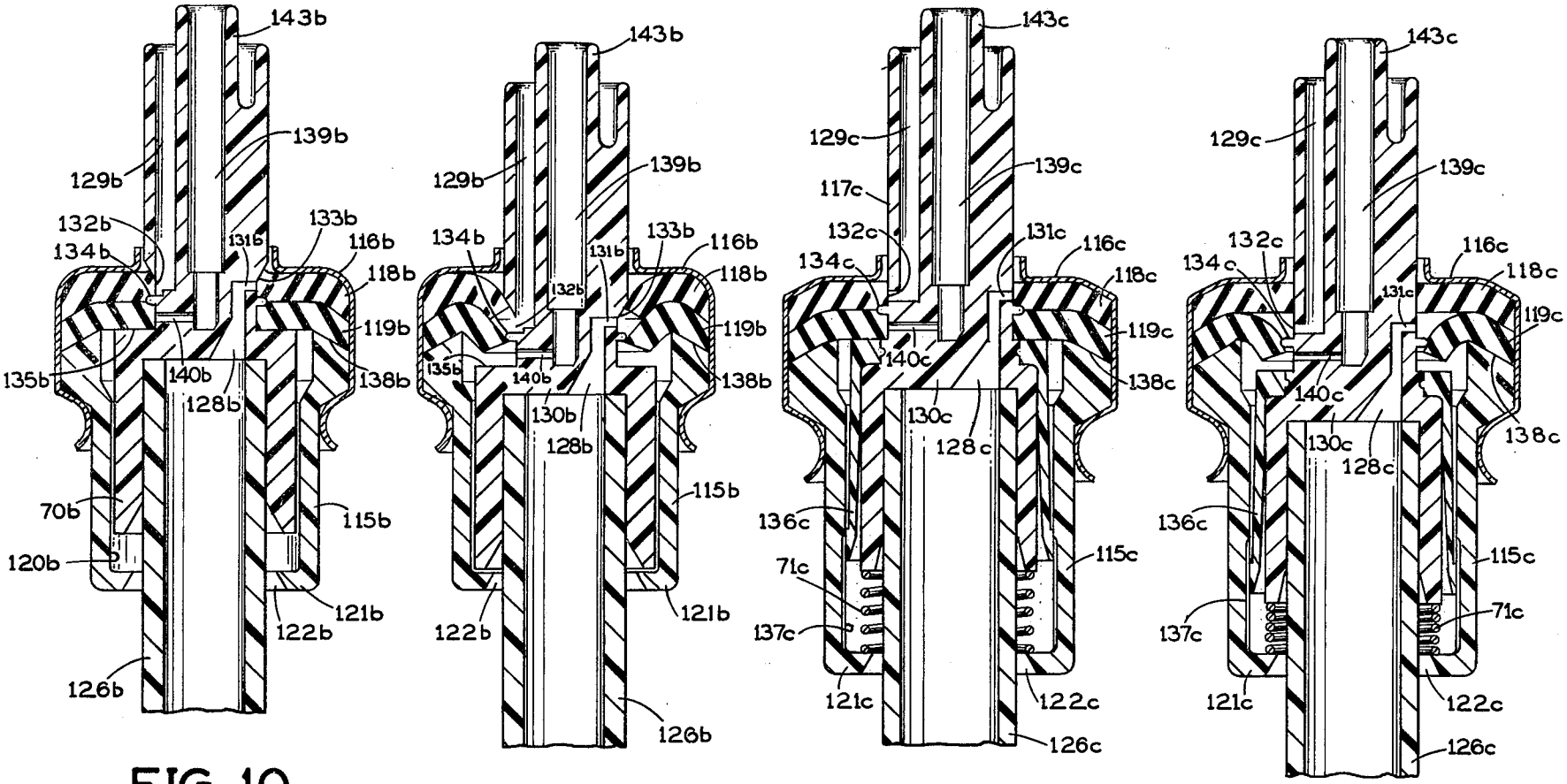
FIG. 10 is a similar view of a fourth embodiment of the present valve.
FIG. 11 is a view similar to FIG. 10 but with the valve opened.
FIG. 12 is a view similar to FIG. 1 of a fifth embodiment of the present valve.
FIG. 13 is a view similar to FIG. 12 but with the valve opened.

FIGS. 10 and 11 show a fourth embodiment of the present valve, corresponding elements of which are given the same reference numerals as those in FIG. 7, but with a "b" suffix added. In this embodiment the mounting ring **115*b* has a cylindrical inside surface 120*b* without grooves. The loose fit between the outside of the enlarged cylindrical lower end 70*b* of the valve body and this surface 120*b*** may result in some splitting of product when the container is shaken, but this may not be objectionable for some applications.

FIGS. 12 and 13 show a fifth embodiment essentially similar to the embodiment of FIGS. 1 and 2 as well as 10 and 11. A bias spring **71*c* is provided. Elements of the valve shown in FIGS. 12 and 13 which correspond to those in the valve of FIGS. 10 and 11 are given the same reference numerals but with a "c" suffix added. In FIGS. 12 and 13, the valve body 117*c* slides down into the upper gasket 118*c* without flexing it when the valve is opened (FIG. 13). The skirt 136*c*** is a separate, soft piece which attaches to a harder valve body as shown.

Figure 15:
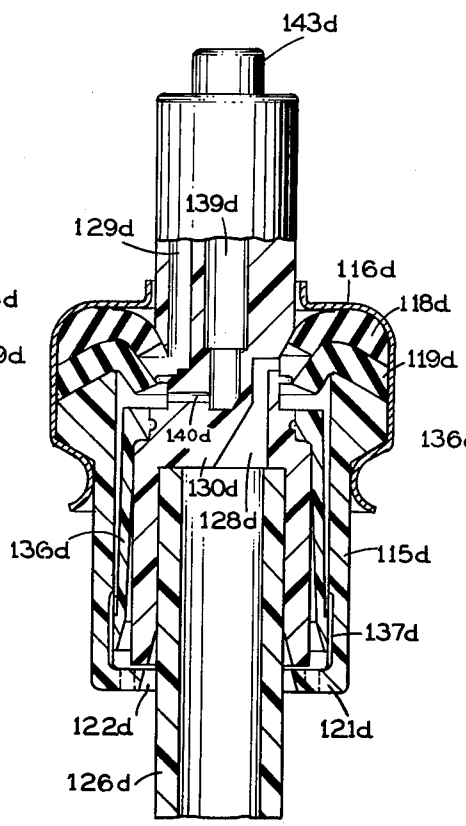
FIGS. 14 and 15 show a sixth embodiment.
Figure 14:
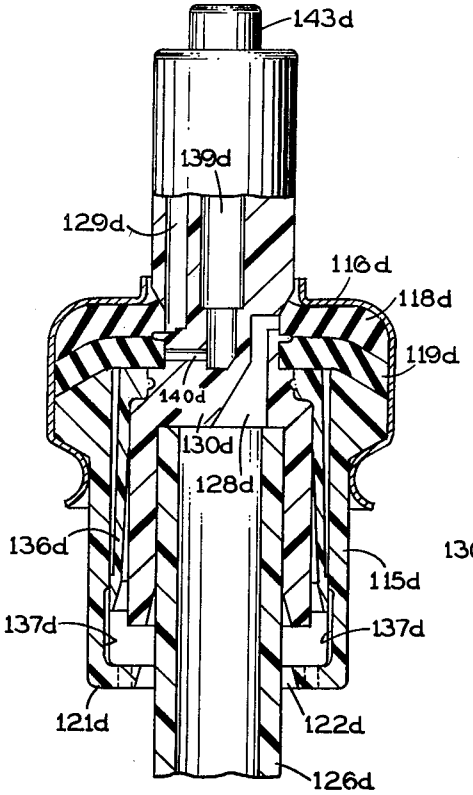

FIGS. 14 and 15 show a sixth embodiment similar to FIGS. 12 and 13 except with the bias spring omitted and both gaskets bending during operation. This embodiment also includes a softer skirt **136*d*** which is affixed to a harder valve body.

Figure 17:
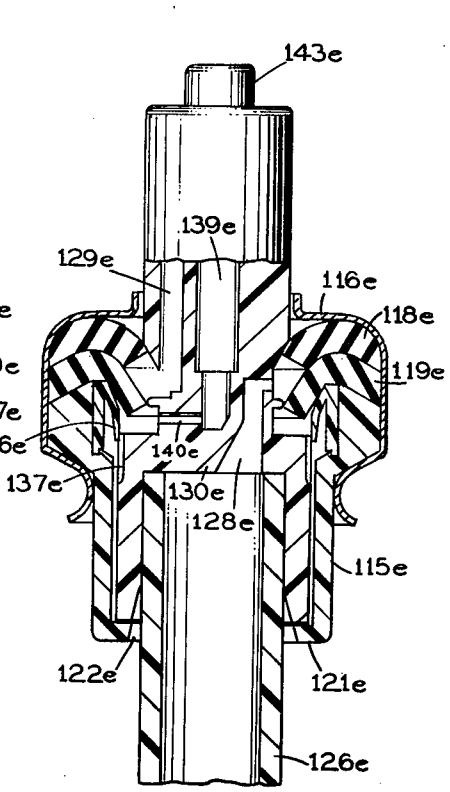
FIGS. 16 and 17 show a seventh embodiment.
Figure 16:
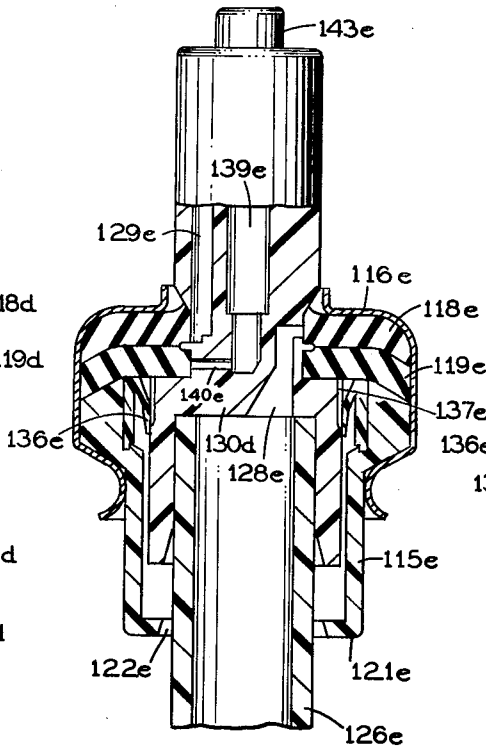

FIGS. 16 and 17 show a seventh embodiment in which the softer skirt **136*e*** is affixed to the mounting ring.

The ability to use a separate, softer skirt on the valve body insures a good seal, reduces rejects during manufacturing, and allows faster assembly.

I claim:

1. In a valve for use with a pressurized aerosol dispensing container having a mouth and containing pressurized product, said valve having:

hollow annular mounting means for sealed attachment to the mouth of the container and having an annular inside surface;

a tubular valve body extending down through said mounting means and axially displaceable therein between a normal upper position and a downwardly displaced lower position, said valve body having an internal transverse wall intermediate its length and a longitudinal eduction passageway below said wall and a longitudinal product discharge passageway above said wall, said valve body having a transverse orifice opening directly into the upper end of said eduction passageway below said wall and a transverse orifice opening directly into the lower end of said product discharge passageway above said wall;

and a first annular, elastomeric sealing gasket extending circumferentially around said valve body transverse to the latter, said gasket having an annular inside edge which defines a central opening therein which snugly receives said valve body and closes said orifices in said normal position of the valve body;

the improvement which comprises:

a second annular, elastomeric sealing gasket extending circumferentially around said valve body transverse to the latter contiguous to said first gasket, said second gasket having an annular inside edge which defines a central opening therein which snugly receives said valve body in said normal position of the valve body;

means on the valve body for flexing the lower of said gaskets downward adjacent its central opening, when the valve body is displaced downward from said normal position, to provide a first connecting passageway between the two gaskets adjacent their respective central openings;

a transverse, annular, outwardly extending, upwardly-facing shoulder on the valve body extending below said lower gasket, said shoulder moving down away from said lower gasket to form between them a second connecting passageway adjacent the central opening in the lower gasket when the valve body is displaced downward to flex said lower gasket;

said valve body, when displaced downward from its normal position, positioning said orifices in registration with one of said connecting passageways to connect the upper end of said eduction passageway to the lower end of said product discharge passageway in the valve body;

means providing one or more restricted passageways extending from outside said mounting means in the container into the other of said connecting passageways for passing gaseous propellant into the latter when the valve body is displaced downward;

means defining a propellant discharge passageway extending up from said internal transverse wall separate from said product discharge passageway;

and means defining a lateral passage at the lower end of said propellant discharge passageway for registration with said other connecting passageway to pass propellant therefrom up into said propellant discharge passageway when the valve body is displaced downward;

said second gasket sealingly engaging said valve body in the latter's normal position to block said lateral passage from fluid communication with said one or more restricted passageways.

2. A valve according to claim 1, wherein:

said second gasket is directly below said first gasket;

said one connecting passageway is formed between the gaskets when the valve body is displaced downward;

said other connecting passageway is formed between the second gasket and said upwardly-facing shoulder on the valve body;

and said means on the valve body for flexing the lower gasket is a peripheral projection on the valve body sandwiched between the bottom of the first gasket and the top of the second gasket adjacent their respective central openings in the normal position of the valve body, said projection flexing said second gasket downwardly adjacent its central opening, when said valve body is displaced downward from said normal position, to provide said one connecting passageway with which said orifices in the downwardly-displaced valve body register for passing product from said eduction passageway through said one connecting passageway up into said product discharge passageway.

3. A valve according to claim 2, wherein said second gasket at its annular inside edge sealingly engages the valve body at said lateral passage in said normal position of the valve body.

4. A valve according to claim 2, wherein the bottom of said second gasket sealingly engages said upwardly-facing shoulder on the valve body in said normal position of the valve body.

5. A valve according to claim 4, wherein said second gasket at its annular inside edge sealingly engages the valve body at said lateral passage in said normal position of the valve body.

6. A valve according to claim 2, wherein said peripheral projection extends circumferentially around the outside of the valve body, and each of said connecting passageways extends annularly around the valve body.

7. A valve according to claim 1, wherein said mounting means is a mounting ring having one or more narrow longitudinal grooves on the inside which provide said one or more restricted passageways.

8. A valve according to claim 7, wherein said valve body has an annular skirt extending down from the periphery of said upwardly-facing shoulder and slidably engaging the inside of said mounting ring.

9. A valve according to claim 7, and further comprising an elastomeric O-ring on the outside of said valve body in sealing engagement with the inside of said mounting ring at the upper end of said one or more grooves in said normal position of the valve body.

10. A valve according to claim 1, and further comprising spring means biasing said valve body to said normal position thereof.

11. A valve according to claim 2, wherein:

said transverse interior wall of the valve body has vertically offset portions;

said eduction passageway orifice is above at least part of said product discharge passageway orifice;

and said orifices have bottom edges, with the bottom edge of said product discharge passageway orifice being below the bottom edge of said eduction passageway orifice.

12. A valve according to claim 11, wherein said second gasket at its annular inside edge sealingly engages the valve body at said lateral passage in said normal position of the valve body.

13. A valve according to claim 11, wherein the bottom of said second gasket sealingly engages said upwardly-facing shoulder on the valve body in said normal position of the valve body.

14. A valve according to claim 13, wherein said second gasket at its annular inside edge sealingly engages the valve body at said lateral passage in said normal position of the valve body.

15. A valve according to claim 11, wherein said peripheral projection extends circumferentially around the valve body, and each of said connecting passageways extends annularly around the valve body.

16. A valve according to claim 15, wherein said mounting means is a mounting ring having one or more longitudinal grooves on the inside which provide said one or more restricted passageways.

17. A valve according to claim 16, wherein said valve body has an annular skirt extending down from the periphery of said upwardly-facing shoulder and slidably engaging the inside of said mounting ring.

18. A valve according to claim 16, and further comprising an elastomeric O-ring on the outside of said valve body in sealing engagement with the inside of said mounting ring at the upper end of said one or more grooves in said normal position of the valve body.

19. A valve according to claim 16, and further comprising a spring acting between said mounting ring and said valve body and biasing upward to said normal position thereof.

20. The valve according to claim 15 wherein said mounting means has an annular skirt slidably and sealingly engaging said valve body and said valve body has one or more grooves therein for interrupting the seal of said skirt.

21. The valve according to claim 17 in which said skirt is a separate piece.

22. The valve according to claim 20 wherein said skirt is a separate piece.

* * * * *